United States Patent [19]

Ramsey et al.

[11] Patent Number: 4,928,949

[45] Date of Patent: May 29, 1990

[54] LOW PAPER INDICATOR

[75] Inventors: James S. Ramsey, Shelton; John L. Lorenzo, Southbury, both of Conn.

[73] Assignee: Pitney Bowes Inc., Stamford, Conn.

[21] Appl. No.: 292,052

[22] Filed: Dec. 30, 1988

[51] Int. Cl.[5] ..... B65H 7/00; B65H 43/00

[52] U.S. Cl. ..... 271/111; 271/154; 271/258; 271/265

[58] Field of Search ..... 271/110, 111, 154, 258, 271/259, 263, 265

[56] References Cited

U.S. PATENT DOCUMENTS

| | | | |
|---|---|---|---|
| 3,971,918 | 7/1976 | Saito | 235/92 SB |
| 3,977,666 | 8/1976 | Suzuki et al. | 271/111 |
| 4,386,769 | 6/1983 | Ito et al. | 271/111 |
| 4,467,949 | 8/1984 | Nakata | 226/45 |
| 4,585,221 | 4/1986 | Lillibridge | 271/10 |

FOREIGN PATENT DOCUMENTS

| | | | |
|---|---|---|---|
| 161740 | 12/1980 | Japan | 271/111 |
| 98446 | 6/1982 | Japan | 271/111 |
| 63637 | 4/1983 | Japan | 271/258 |
| 119530 | 7/1983 | Japan | 271/258 |
| 2640 | 1/1986 | Japan | 271/265 |
| 86336 | 5/1986 | Japan | 271/154 |
| 155138 | 7/1986 | Japan | 271/154 |
| 155143 | 7/1986 | Japan | 271/154 |
| 249849 | 10/1987 | Japan | 271/111 |

*Primary Examiner*—Kevin P. Shaver
*Assistant Examiner*—Steven Reiss
*Attorney, Agent, or Firm*—Charles R. Malandra, Jr.; Melvin J. Scolnick; David E. Pitchenik

[57] ABSTRACT

In accordance with the foregoing objects, the present invention provides for a source and detector arranged in the path of a diminishing supply of documents, the strategically located detector responding to the absence of a supply at a specific point for providing an indication that the document supply or the like is getting low so that an operator may refill the supply before it runs out.

12 Claims, 4 Drawing Sheets

LOW PAPER INDICATOR

BACKGROUND OF THE INVENTION

1. Field of the invention

The present invention relates to document feeding mechanisms, and more particularly to a low level indicator for such feeding mechanisms. In applications requiring the feeding of particular documents, such as envelopes and the like, especially in high-speed environments, it is inconvenient to require operator intervention when the paper supply is depleted. The time required to replenish the depleted paper supply is time lost from the main processing line to which the documents are directed. Avoidance of the shut down of a feeder mechanism for reloading during a run is therefore desirable.

Particularly in multiple-feeder operations, it is desirable to provide an indication of low paper whenever it occurs during a run so that a large scale processing line employing a plurality of supplied documents may be continually replenished prior to actual shut down of any one feeder which in turn would necessitate shut down of the entire run.

2. Description of the Prior Art

The patent to Lillibridge, 4,585,221, provides an optical sensor for an envelope stack but operates to turn the machine off when the stack diminishes to a preset level, rather than indicating that an operator should refill the stack to maintain operation.

The patent to Saito, 3,971,918, discloses optical measurement of the number of a plurality of stacked corrugated cardboards, to provide an indication of the count, but does not indicate a manner wherein signals can be provided to the operator to refill the stack to maintain operation prior to shut down of the machine.

The patent to Nakata, 4,467,949, shows a paper detector for controlling a paper feed device, but does not provide a system wherein early warning signals may be provided to an operator prior to depletion of paper supply during a high-speed run.

Particularly in multiple-feeder operations, it is desirable to provide an indication of low paper whenever it occurs during a run so that a large scale processing line employing a plurality of supplied documents may be continually replenished prior to actual shut down of any one feeder which in turn would necessitate shut down of the entire run.

3. SUMMARY OF THE INVENTION

It is the principal object of the present invention to provide a low-level indication of document supply during feeder operation.

It is another object of the present invention to provide operator indication of low-document supply over a pre-determined range of level conditions.

It is a further object of the present invention to provide varying operator indication levels of multiply fed documents from a plurality of feeders thus allowing operator invention for replenishment at differing points of operation of the feeder supplies.

It is another object of the foregoing invention to provide a specific arrangement of sensors within each feeding station to provide multiple signals levels indicating both the feeding station and the relative position of the supply of documents in such station.

It is a further object of the present invention to provide for automatic indication to an operator for refilling the supply of each document feeder in an arrangement employing a plurality of document feeders, with provision for displaying to the operator supply level conditions in each feeder.

In accordance with the foregoing objects, the present invention provides for a light source and detector arranged in the path of the diminishing supply, strategically located, and which responds to the absence of a supply at a specific point for providing an indication that the document supply is getting low so that an operator may refill the supply before it runs out.

4. BRIEF DESCRIPTION OF THE DRAWINGS

DETAILED DESCRIPTION OF THE INVENTION

While the present invention will be described in connection with a preferred embodiment thereof, it will be understood that it is not intended to limit the invention to that embodiment only. On the contrary, it is intended to cover all alternatives, modifications and equivalences as may be reasonably included within the spirit and scope of the invention as defined by the appended claims.

Figure 1:
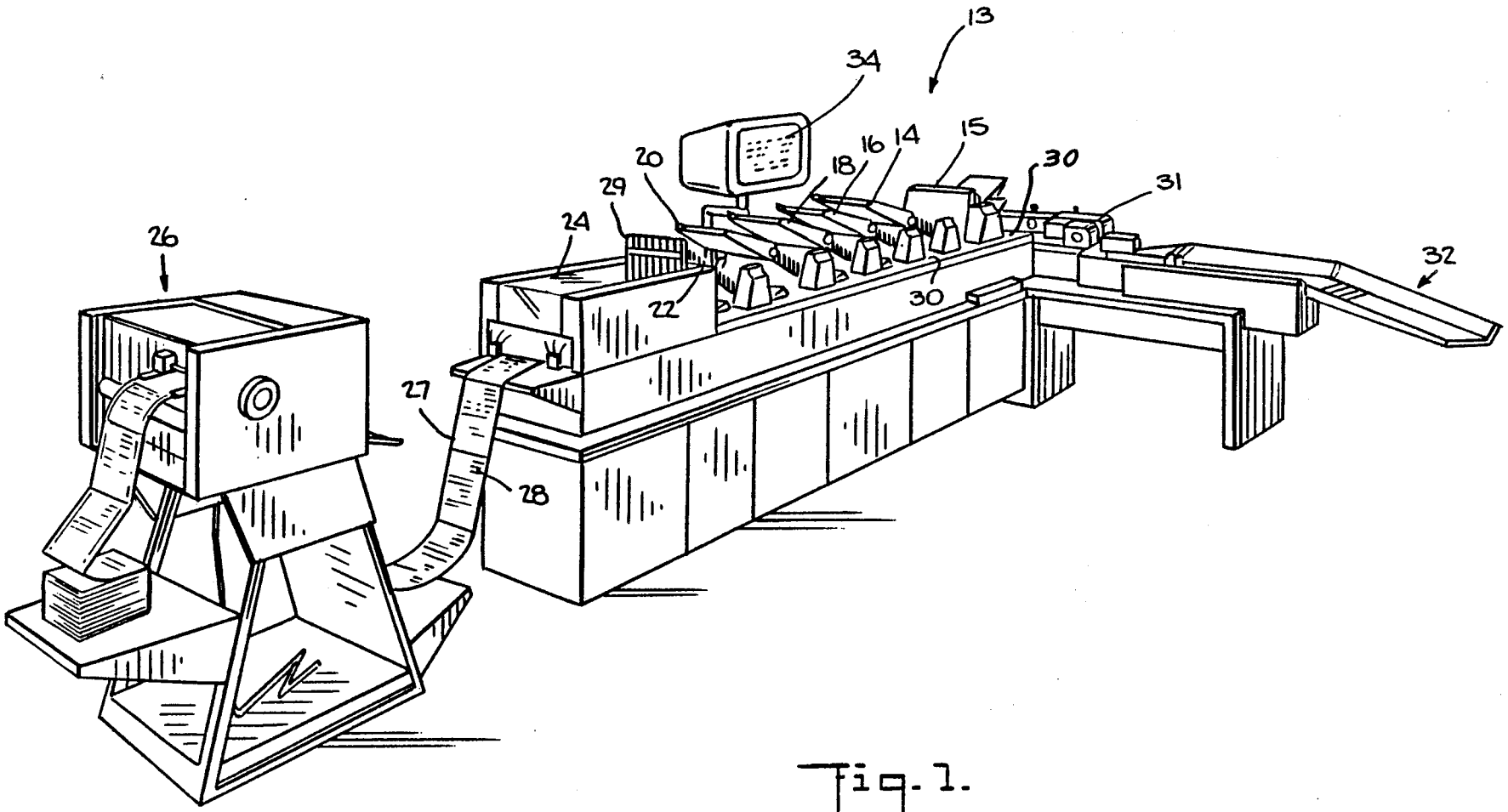
FIG. 1 is a perspective view of a typical mailing machine employing a plurality of input feeder units.

In reference to FIG. 1, there is shown a typical configuration of a universal multi-station document inserter, further details of which may be found with reference to U.S. Pat. No. 4,517,650, issued Aug. 14, 1985 to the assignee of the present application. The present invention will be disclosed in conjunction with an envelope feeder module such as may be employed with the foregoing described universal multi-station document inserter, but it will be understood that the present invention is applicable to any situation which requires the feeding of multiple documents wherein replenishment prior to exhaustion is desirable.

Referring to FIGS. 1, a document inserter in accordance with the present invention is generally illustrated at 13. The typical document inserter 14 includes a plurality of serially arranged modules including an envelope feeder station or module 15 and six document feeder stations or modules, including five feeder modules designated 14, 16, 18, 20, 22, and burster-folder station or module 24. A computer generated form 26 feeds continuous form control documents 27 having coded marks 28 thereon to the burster-folder 24 for separating and folding. The coded marks 28 on the control documents 27 are sensed by a control scanner 29. Thereafter the serially arranged feeder stations 22, 20, 18, 16 and 14 sequentially feed the necessary documents onto the transport deck 30 at each station as the control document 27 arrives at the respective station to form a precisely collated stack of documents which is to be transferred to the envelope feeder 15.

The collated stack of documents is inserted in an envelope at the envelope station 15. The envelope is sealed and the necessary postage is stamped on the envelope by meter 31. As desired, the completed envelopes may then be transported to a single or multi-station level stacker 32.

The inserter 13 also includes a central control display 34 which displays status messages and fault signals in human readable form and further enables the operator to control and change the configuration of the inserter 13 by way of finger touch switches.

Figure 2A:
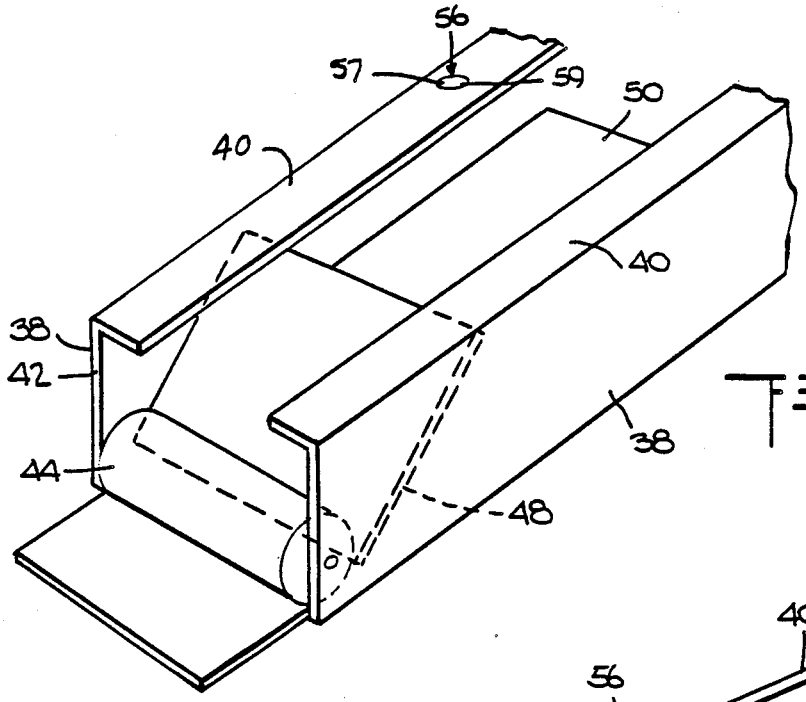
FIG. 2A and 2B are respectively perspective and side views of a single feeder showing the arrangement including a plurality of source documents and sensors.
Figure 2B:
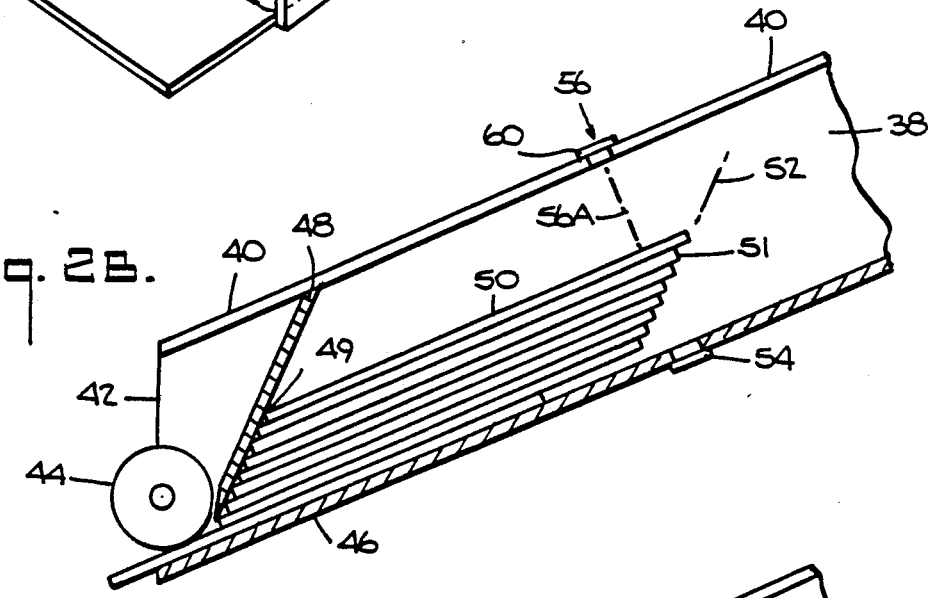

Referring now to FIGS. 2A and 2B, a typical feeder module is illustrated. In this typical configuration, the feeder module includes sidewalls 38, top 40, front edges 42, feeder roll 44, a bottom support surface 46 and an appropriate front edge document aligning and support surface 48 which may or may not be included depending upon the size of the feed or roll 44 and the type of document being supplied. The support surface 46 supports a stack of documents 50 typically of common width. The sides 38 of the feeder and the surface 48 together form a guide wall against which first edges 49 of the documents 50 of a stack on said support surface are urged, whereby second edges 51 of said documents opposite said first edges lie in a common plane defined by the line 52 The feed rollers 44 provide a means for separating documents from the bottom of said stack of documents, and the document stack descends along the plane defined by the line 52. In order to indicate to an operator of said system the need for replenishing documents in the stack, a sensor 54 is positioned in the support surface 46. A source of radiation 56, which is preferably ambient light, to which the sensor 54 is responsive, is mounted above the sensor at a position whereby a straight line 56A from the source to the sensor extends at an acute angle to, and passes through, the common plane line 52. The amount of radiation from the source 56 impinging upon the sensor 54 is a function of the number of documents on the stack. Appropriate indicating means is connected to said sensor to provide operator alert.

The aligning surface 48 is positioned to define the common plane line 52 so as to extend at an acute angle to the support surface 46. The sensor 54 is mounted in the support surface 46 at a position spaced from said aligning surface 48 a distance greater than the width of said documents. If for example, the documents 50 consist of a plurality of envelopes, the feed roll 44 rotates in the clockwise direction pulling envelopes out from beneath the envelope stack 50 in the direction such that the stack 50 would constantly deplete. In an inclined path machine the documents would form a stack, the edge of which forms an acute angle with inside bottom surface of the lower support surface 46. As the documents continue to feed by virtue of the action of the feed roller 44, the height of the stack diminishes, thereby exposing more of the bottom surface 46 relative to the aligning surface 48. By appropriately positioning a sensor, indicated at 54, in a location normally greater than the width of a single document from the feed roller but below the uppermost documents of the stack 50, the sensing of predetermined diminishment of the paper supply rather then absolute depletion can be accomplished in accordance with the invention. To complete the sensing arrangement, an appropriately positioned light source 56 directs an impinging light beam along line 56A towards the sensor 54. As the stack diminishes, the sensor 54 becomes uncovered, and becomes increasingly exposed to the light from source 56. At a predetermined light level, the sensor 54 operates a suitable electrical circuit, thus providing a low-warning indication to the operator prior to total depletion of the document stack, thereby allowing the operator to replenish the document stack without interfering with the continuing operation of the machine.

Ambient light is preferred as light source 56. This light source may be intensified by placing a light concentrating lens 57 in an aperture 59 in the upper wall 40. The light source may also be a locally generated light, such as a LED or lens 60.

Figure 3:
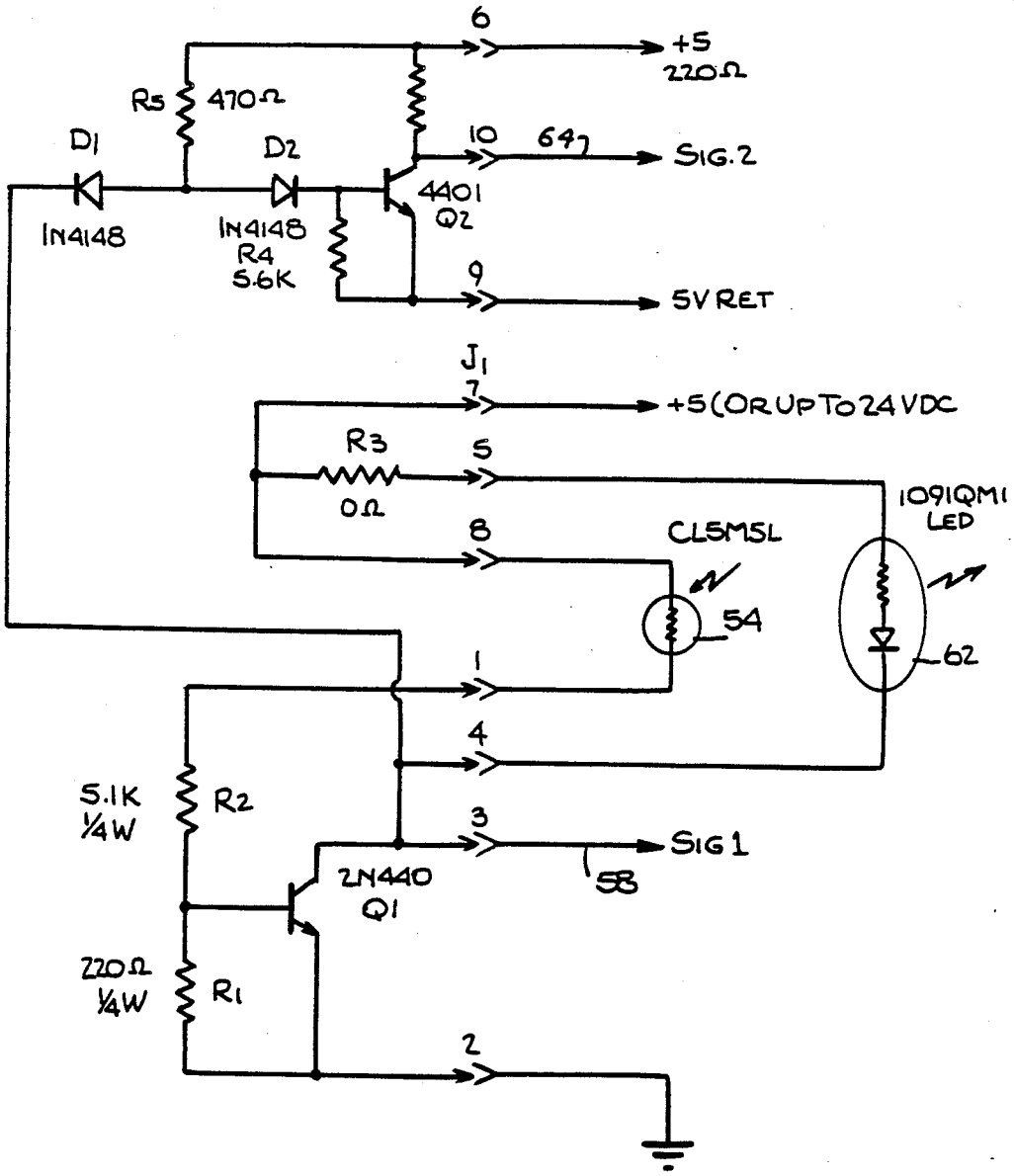
FIG. 3 is a circuit diagram that may be employed with the present invention.

With reference to FIG. 3 a suitable electrical circuit for implementing the sensing and detecting arrangement of FIG. 2 is shown. The arrangement includes two transistors, Q1 and Q2, suitably biased by appropriate resistors and diodes, and coupled between a five volt supply and ground. Photoresistor 54 which may be a typical Clairex type CL5M5L, is energized by the five volt supply and is coupled through biasing resistors R1 and R2 to the base of Q1. A suitable light-emitting diode 62, similarly biased and energized by the five volt supply provides appropriate warning light source for troubleshooting. When the photo resistor 54 is exposed to the ambient light, the resistance of the photoresistor 54 drops resulting in a pre-determined bias at the base of Q1 determined by the values of resistors R1 and R2 level, thereby driving the base of the transistor Q1 positive and causing Q1 to go into saturation, resulting in the collector of Q1 being driven to ground level. This ground level, provided over line 58, represents a logic level indicative of the condition of light exposure of sensor 54. When the collection of Q1 is driven towards ground, the five volt supply drives sufficient current through the LED 62 to cause the diode to light, thereby providing a visual warning of low level conditions. Similarly, through diode D1 to the base of the transistor Q2, the transistor Q2 is driven out of saturation, causing the collector thereof to be driven to the supply voltage level, a logical high, along line 64. The logical low and high signals may be used by conventional appropriate circuitry (not shown) for driving the display 34 (FIG. 1) indicating the condition of the document module to the operator. The display 34 can provide appropriate signal conditions indicative of the condition of the sensors in each of the document feeder modules. The detector circuit is typically prebiased so that exposure of approximately 25 percent of the surface area of the photo detector 54 will cause transistor Q1 to be driven into saturation, thereby providing the appropriate logical shift indicative of a replenishment condition to which the operator should respond.

Figure 4:
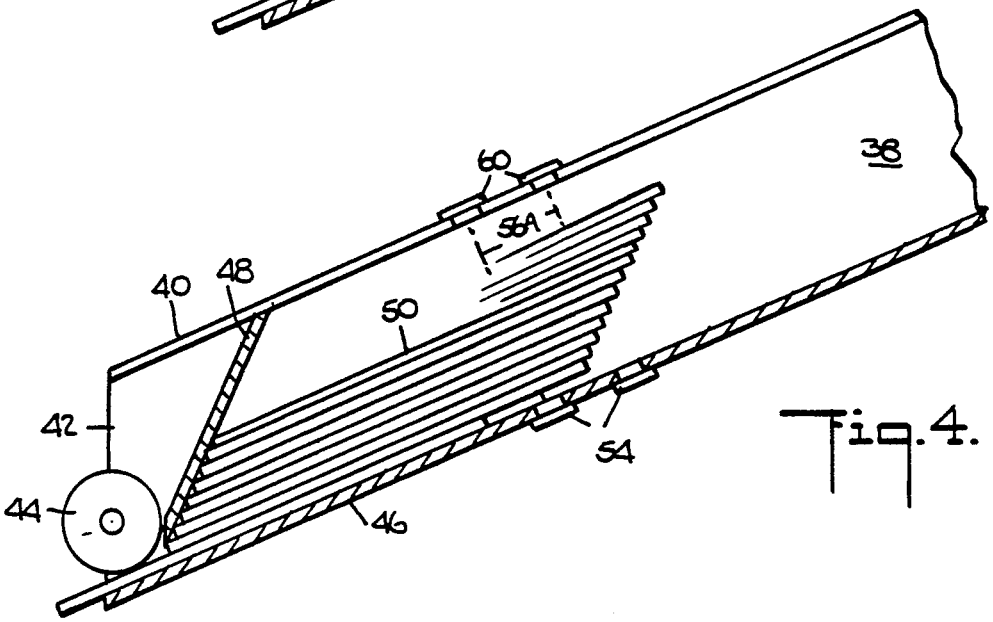
FIG. 4 is an alternative arrangement of a document feeder employing a plurality of sensors.

Referring to FIG. 4, an arrangement is shown whereby the document feeder module may be provided with a plurality of sensors 54, driven either by ambient light or by artificial light, located along the path of the feed line, for indicating two conditions, first an early warning condition where approximately 25–40 percent of the documents have been fed, and a second more urgent later condition indicating that approximately 80–90 percent of the documents have been fed.

Figure 5:
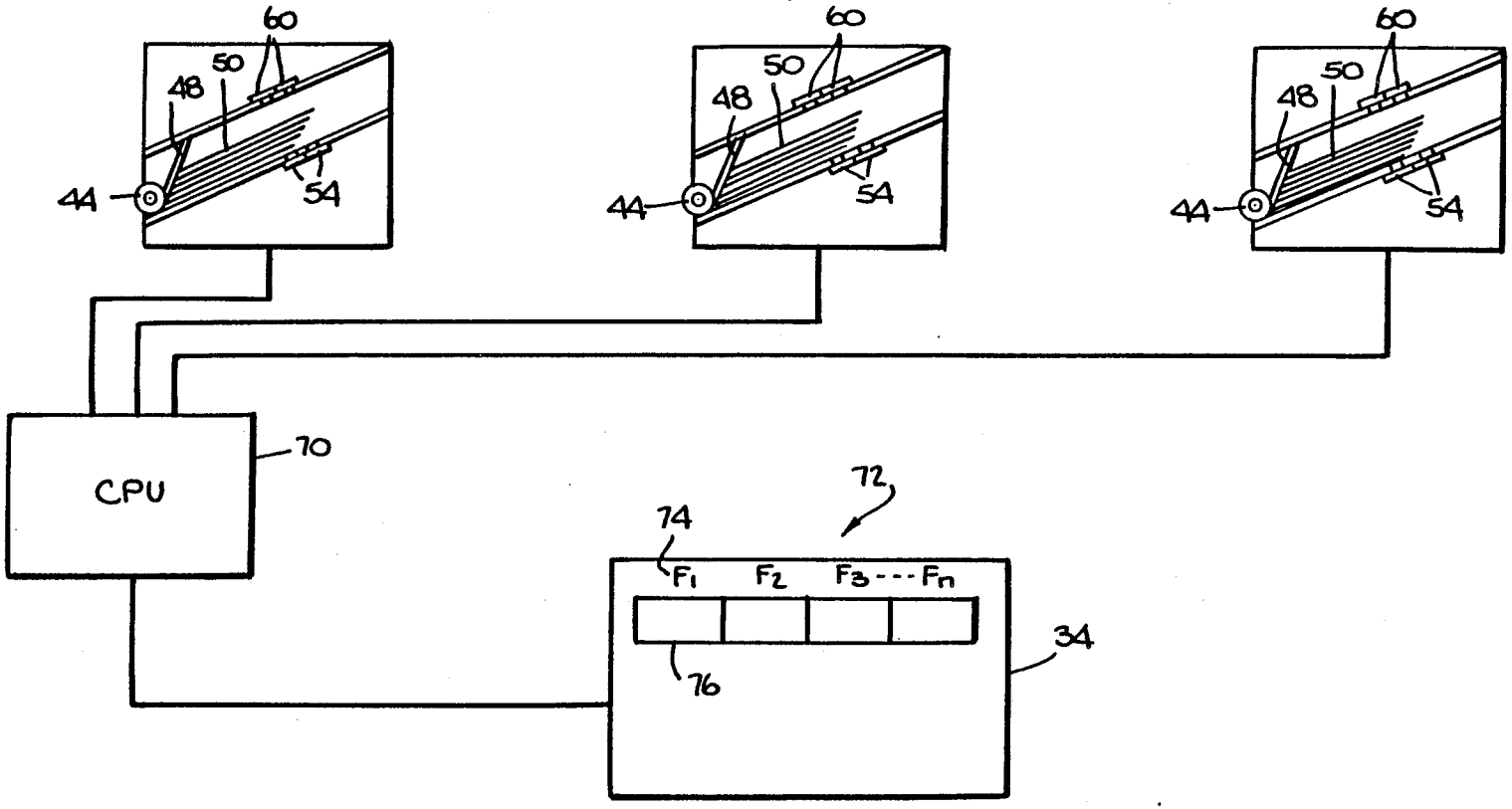
FIG. 5 is an illustration of the manner wherein a plurality of feeding stations can be integrated within a single control to adequately cycle document replenishment.

With reference to FIG. 5, there is shown a plurality of document feeder stations, employing a plurality of sensors 54, integrated so that the various signal indications are provided on the display screen 34, these appropriate signal levels indicating various conditions for document supply. Thus, in a high speed mailing situation where only a single operator is present, and presuming the existence of perhaps 5 or 6 modular feeder units for inputted documents, each set of sensor output signals are provided along a plurality of data lines to a central processing unit 70 which will mix and combine the signals for display purposes on the screen 34 to indicate in visual fashion the specific condition of each document feeder with regard to each of the sensors being exposed. As an alternative, it will be understood that the sensors indicated in FIG. 5 may each comprise a plurality of sensors along the document feed path in each module, each exposed to appropriate light source(s) for providing a continuous document feed level to the display screen 34. In either case, the display screen 34 may display at operator command a plurality of fields which can provide either graphic or numeric display of the content of each of the document feeders. In addition to the visual display, it will be apparent that an audio display, in the nature of alarm condition or light, may be also be provided for indicating document feed levels in each of the appropriate feeder modules.

As is shown on the typical display screen, a plurality of fields 72 are indicated Each of the fields provided with a field heading or title 74, indicating the location of the feeders here indicated as F1, F2, F3, . . . FN. Below the field title 74 there is a field content area 76 which will indicate to the operator the contents in terms of either amount or magnitude of remaining documents in each designated feeders.

Thus, what has been herein described is a method and apparatus for arranging for a replenishment of documents in a document feeder in a single or multiple document feed arrangement which will allow for continuous replenishment of documents before the documents run out, thereby facilitating replenishment prior to stopping the machine and otherwise inhibiting the continuous high-speed operation of the machine itself.

What is claimed is:

1. A document feeder having a detector arrangement for detecting a partially depleted supply of documents, said detector arrangement comprising:

a feeder having a support surface for supporting a supply of documents in a stack, means for aligning the stack of documents so that trailing edges of the documents form an acute angle with said support surface, and sensing means mounted in said feeder for sensing a partial supply of documents, said sensing means being positioned wherein when said feeder has a fully supply of documents said sensing means is between the trailing edges of a bottom document and a top document in the stack of documents.

2. The detector arrangement according to claim 1, wherein said sensing means comprises a light source and a photo detector.

3. The detector arrangement according to claim 2, wherein said light source is ambient light.

4. The detector arrangement according to claim 2, wherein said light source and said photo detector are arranged opposite each other in a top side of said feeder and in said support surface.

5. The detector arrangement according to claim 1, further comprising means coupled to said sensing means for providing an indication of the partial supply of documents.

6. The detector arrangement according to claim 5, wherein said document stack in said feeder can be replenished without interrupting continuing operation of said feeder.

7. The detector arrangement according to claim 1, wherein said sensing means comprises a plurality of sensors positioned so that when said feeder has a full supply of documents, said sensors are positioned between the trailing edges of the bottom and top documents in the stack, whereby each sensor detects different depletion levels in the supply of documents.

8. In an apparatus employing a plurality of document feeders, a detector arrangement comprising:

a plurality of feeders, each of said feeders having a support surface for supporting a supply of documents in a stack and an alignment surface for aligning the stack of documents so that trailing edges of the documents form an acute angle with said support surface, a plurality of sensors located within each of said feeders for sensing a plurality of document supply conditions, each of said sensors positioned in each respective feeder wherein when said respective feeder has a full supply of documents each of said sensors has a different position between the trailing edges of a bottom document and a top document in the stack of documents whereby each of said sensors detects a different depletion level in the supply of documents, logic circuit means operatively coupled to each of said feeders for receiving and collating document supply condition signals from each of said sensors, and display means operatively coupled to said logic circuit means for displaying the document supply condition of each of said feeders in accordance with the supply condition sensed by each of said sensors.

9. The detector arrangement according to claim 8, wherein each of said sensors includes a light source and a photo detector.

10. The detector arrangement according to claim 9, wherein, for each of said sensors, said light source and said photo detector are arranged opposite each other in a top side and in said support surface of the respective feeder.

11. The detector arrangement according to claim 10, wherein said document stack in each of said feeders can be replenished without interrupting continuing operation of said feeder.

12. The detector arrangement according to claim 9, wherein said light source is ambient light.

* * * * *